US008202002B2

(12) United States Patent
McMahon et al.

(10) Patent No.: US 8,202,002 B2
(45) Date of Patent: Jun. 19, 2012

(54) RECLOSABLE VACUUM STORAGE BAG HAVING FLAT RESEALABLE MEANS

(75) Inventors: Michael J. McMahon, Palatine, IL (US); Donald L. VanErden, Wildwood, IL (US); Kevin P. Olechowski, Bourbonnais, IL (US); Steven Ausnit, New York, NY (US); Stanley Piotrowski, Addison, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/719,830

(22) Filed: Mar. 8, 2010

(65) Prior Publication Data

US 2010/0166341 A1 Jul. 1, 2010

Related U.S. Application Data

(60) Division of application No. 11/173,848, filed on Jul. 1, 2005, now Pat. No. 7,674,039, which is a continuation-in-part of application No. 10/370,310, filed on Feb. 19, 2003, now Pat. No. 7,036,988.

(51) Int. Cl.
*B65D 33/16* (2006.01)
*B65D 33/01* (2006.01)

(52) U.S. Cl. ..... 383/61.2; 383/59; 383/63; 383/103

(58) Field of Classification Search ..... 383/63, 383/100, 101, 59, 61.2, 103, 36, 44, 48
See application file for complete search history.

(56) References Cited

U.S. PATENT DOCUMENTS

| | | | | | |
|---|---|---|---|---|---|
| 2,779,370 | A | * | 1/1957 | Wittenberg | 383/59 |
| 3,164,186 | A | * | 1/1965 | Weber et al. | 141/390 |
| 3,343,233 | A | * | 9/1967 | Gould | 24/400 |
| 4,709,396 | A | | 11/1987 | Voshall et al. | |
| 4,709,397 | A | | 11/1987 | Voshall et al. | |
| 4,759,642 | A | | 7/1988 | Van Erden et al. | |
| 4,832,505 | A | | 5/1989 | Ausnit et al. | |
| 4,905,298 | A | | 2/1990 | Walor | |
| 4,944,409 | A | | 7/1990 | Busche et al. | |
| RE34,554 | E | * | 3/1994 | Ausnit | 383/63 |
| 5,492,411 | A | | 2/1996 | May | |
| 5,540,500 | A | * | 7/1996 | Tanaka | 383/43 |
| 5,701,996 | A | | 12/1997 | Goto et al. | |
| 5,829,884 | A | * | 11/1998 | Yeager | 383/45 |
| 5,839,582 | A | | 11/1998 | Strong et al. | |
| 5,911,508 | A | * | 6/1999 | Dobreski et al. | 383/5 |
| 5,951,453 | A | | 9/1999 | Yeager | |
| 6,010,244 | A | * | 1/2000 | Dobreski et al. | 383/63 |

(Continued)

FOREIGN PATENT DOCUMENTS

JP 7-223657 8/1995

(Continued)

*Primary Examiner* — Jes F Pascua
(74) *Attorney, Agent, or Firm* — Ostrager Chong Flaherty & Broitman PC

(57) ABSTRACT

A reclosable vacuum storage bag that can be hermetically sealed by flat resealable means that extend across the full width of the bag. The flat resealable means are designed to provide a barrier to prevent ambient air from leaking into the evacuated interior volume of the bag. The storage bag is also provided with a plastic zipper. The flat resealable means can be arranged on the product side of the zipper, on the user side of the zipper, or in between two zippers installed in the storage bag.

12 Claims, 11 Drawing Sheets

U.S. PATENT DOCUMENTS

| | | | | |
|---|---|---|---|---|
| 6,231,236 | B1 | 5/2001 | Tilman | |
| 6,273,607 | B1 | 8/2001 | Buchman | |
| 6,308,498 | B1 | 10/2001 | Malin et al. | |
| 6,341,688 | B1 | 1/2002 | Graham | |
| 6,350,058 | B1 | 2/2002 | Linton | |
| 6,360,513 | B1 | 3/2002 | Strand et al. | |
| 6,527,444 | B1 * | 3/2003 | Buchman | 383/36 |
| 6,604,634 | B2 | 8/2003 | Su | |
| 6,691,383 | B2 | 2/2004 | Linton | |
| 6,692,147 | B2 * | 2/2004 | Nelson | 383/63 |
| 6,814,491 | B1 | 11/2004 | Tang | |
| 6,854,886 | B2 * | 2/2005 | Piechocki et al. | 383/59 |
| 7,004,632 | B2 | 2/2006 | Hamilton et al. | |
| 7,270,479 | B2 * | 9/2007 | Nelson | 383/63 |
| 7,377,015 | B2 * | 5/2008 | Long et al. | 24/399 |
| 7,437,805 | B2 | 10/2008 | Berich | |
| 7,448,803 | B2 * | 11/2008 | Ootsubo | 383/100 |
| 7,674,491 | B2 * | 3/2010 | Pool et al. | 426/404 |
| 8,061,898 | B2 * | 11/2011 | Pawloski et al. | 383/59 |
| 2002/0162767 | A1 * | 11/2002 | Ohtsubo | 206/524.8 |
| 2003/0066267 | A1 | 4/2003 | Nelson | |
| 2003/0167607 | A1 | 9/2003 | Linton | |
| 2004/0066990 | A1 * | 4/2004 | Schneider et al. | 383/204 |
| 2006/0029300 | A1 | 2/2006 | Yoder | |
| 2008/0232722 | A1 * | 9/2008 | Pawloski et al. | 383/64 |

FOREIGN PATENT DOCUMENTS

| | | | | |
|---|---|---|---|---|
| JP | 08011942 | A | * | 1/1996 |
| JP | 2000072157 | A | | 3/2000 |
| JP | 2000219252 | A | * | 8/2000 |
| JP | 2002193273 | A | * | 7/2002 |
| WO | WO 03101850 | A1 | * | 12/2003 |
| WO | WO 2004091322 | A1 | * | 10/2004 |

* cited by examiner

PRODUCT SIDE

RECLOSABLE VACUUM STORAGE BAG HAVING FLAT RESEALABLE MEANS

RELATED PATENT APPLICATION

This application is a divisional of and claims priority from U.S. patent application Ser. No. 11/173,848 filed on Jul. 1, 2005, which issued on Mar. 9, 2010 as U.S. Pat. No. 7,674,039, which is a continuation-in-part of and claims priority from U.S. patent application Ser. No. 10/370,310 filed on Feb. 19, 2003 and entitled "Zipper for Vacuum Storage Bag", which issued on May 2, 2006 as U.S. Pat. No. 7,036,988.

BACKGROUND OF THE INVENTION

This invention generally relates to storage bags that have means for evacuation. In particular, the invention relates to evacuable storage bags that are reclosable by means a plastic zipper.

Reclosable plastic zippers are useful for sealing thermoplastic pouches or bags. Typically, the plastic zippers include a pair of interlockable fastener elements, or profiles, that form a closure. The profiles in plastic zippers can take on various configurations, e.g. interlocking rib and groove elements having so-called male and female profiles, interlocking alternating hook-shaped closure elements, interlocking ball-shaped closure elements, etc.

For many packaged products, it is desirable to provide means for hermetically sealing the package. For example, it is known to provide a frangible hermetic seal in an unopened reclosable package that contains perishable material, such as foodstuff. However, once the frangible hermetic seal is broken and the package is opened, the hermetic seal cannot be restored when the package is reclosed.

It is also known to store articles of manufacture, such as clothing, in evacuated storage bags having a reclosable zipper. In the case of reclosable storage bags that are evacuated after filling, it is desirable that the reclosed bag be hermetically sealed. Such a hermetic seal must be provided by the plastic zipper. Since it is desirable that such storage bags be reusable, it should be apparent that a one-time frangible hermetic seal is unsuitable.

A known evacuable storage bag relies on zipper profiles that provide mechanical closure and a secondary seal, along with the collapsed packaging film at the bag headspace, which acts as the primary method of sealing the interior volume of the bag from ambient air. The problem with the zipper profiles is that they fail to act as an adequate gas seal when the zipper profiles are distorted, either by the zipper stomping operation or when the bag is folded in half during either final packaging or when used by the customer. Also, on very wide bags, due to unequal elongation when the user improperly closes the zipper with the slider, sometimes the zipper is left partially open. After being distorted, the interconnected and pressed together profiles spread apart and lose their ability to seal off the ambient air. Even the relatively thick (2.5 mils) film at the headspace of the bag, when folded, can create a channel leaker or path for the air to leak into the bag.

There is a continuing need for improvements in resealable zipper designs that provide vacuum-tight sealing of an evacuable storage bag.

BRIEF DESCRIPTION OF THE INVENTION

The invention is directed to a reclosable vacuum storage bag that can be hermetically sealed by flat resealable means that extend across the full width of the bag. The flat resealable means are designed to provide a barrier to prevent ambient air from leaking into the evacuated interior volume of the bag. The storage bag is also provided with a plastic zipper. The flat resealable means can be arranged on the product side of the zipper, on the user side of the zipper, or in between two zippers installed in the storage bag.

One aspect of the invention is a bag comprising: a receptacle having an interior volume and a mouth, the receptacle comprising first and second walls joined at first and second sides and joined or connected at a bottom; first and second zipper parts respectively supported by the first and second walls at or in the vicinity of the mouth, the first zipper part comprising a first closure profile, the second zipper part comprising a second closure profile, and the first and second closure profiles being mutually interlockable; and a flat valve having open and closed states and designed to remain closed when in the closed state while the interior volume of the receptacle is evacuated, the flat valve extending from the first side to the second side of the receptacle and, in the closed state, blocking the passage of air through the flat valve.

Another aspect of the invention is a bag comprising: a receptacle having an interior volume and a mouth, the receptacle comprising first and second walls having respective lower portions that bound the interior volume and respective upper portions that form the mouth; a zipper comprising first and second mutually interlocked zipper parts joined at opposite ends of the zipper and having a zipper chamber therebetween, the first zipper part being joined to the upper portion of the first wall in a first band-shaped zone of joinder, and the second zipper part being joined to the upper portion of the second wall in a second band-shaped zone of joinder; and a coating made of tacky material that covers a portion of one of the first and second zipper parts, the coating being exposed inside and extending the length of the zipper chamber. The zipper comprises a multiplicity of holes disposed such that the zipper chamber is evacuated when the interior volume of the receptacle is evacuated. A portion or portions of the zipper are sufficiently flexible that the coating contacts an opposing surface when the zipper chamber is evacuated.

A further aspect of the invention is a bag comprising: a receptacle having an interior volume and a mouth, the receptacle comprising first and second walls having respective lower portions that bound the interior volume and respective upper portions that form the mouth; a zipper comprising first and second mutually interlocked zipper parts joined at opposite ends of the zipper, the first zipper part comprising a first base strip and first and second closure profiles projecting from one side of the first base strip, the first and second closure profiles being parallel to each other, the first base strip comprising a multiplicity of holes disposed between the first and second closure profiles, and the second zipper part comprising a second base strip and third and fourth closure profiles projecting from one side of the second base strip, the third and fourth closure profiles being parallel to each other and respectively interlocked with the first and second closure profiles, wherein the first base strip is joined to the upper portion of the first wall in a first band-shaped zone of joinder, and the second base strip is joined to the upper portion of the second wall in a second band-shaped zone of joinder, each of the first and second band-shaped zones of joinder being approximately parallel to the interlocked closure profiles when the mouth is straight; and a resealable hermetic seal disposed between the first and second base strips for hermetically resealing the mouth of the receptacle, wherein the resealable hermetic seal comprises a coating covering at least a portion of an interior surface disposed between the closure profiles of one of the first and second base strips and extending the length thereof.

Yet another aspect of the invention is a bag comprising: a receptacle having an interior volume and a mouth, the receptacle comprising first and second walls joined at first and second sides and joined or connected at a bottom; first and second closure profiles that are mutually interlockable for closing the mouth; and first and second flexible webs that extend from the first side to the second side and that adhere or cohere to each other along their entire length to form a hermetic seal that prevents the leakage of ambient air into at least a major portion of the interior volume when the interior volume is evacuated.

Other aspects of the invention are disclosed and claimed below.

BRIEF DESCRIPTION OF THE DRAWINGS

FIG. 8 shows the double zipper assembly before the storage bag is evacuated; FIG. 9 shows the double zipper assembly after the storage bag has been evacuated.

FIG. 10 shows the double zipper assembly before the storage bag is evacuated; FIG. 11 shows the double zipper assembly after the storage bag has been evacuated.

Reference will now be made to the drawings in which similar elements in different drawings bear the same reference numerals.

DETAILED DESCRIPTION OF THE INVENTION

Figure 1:
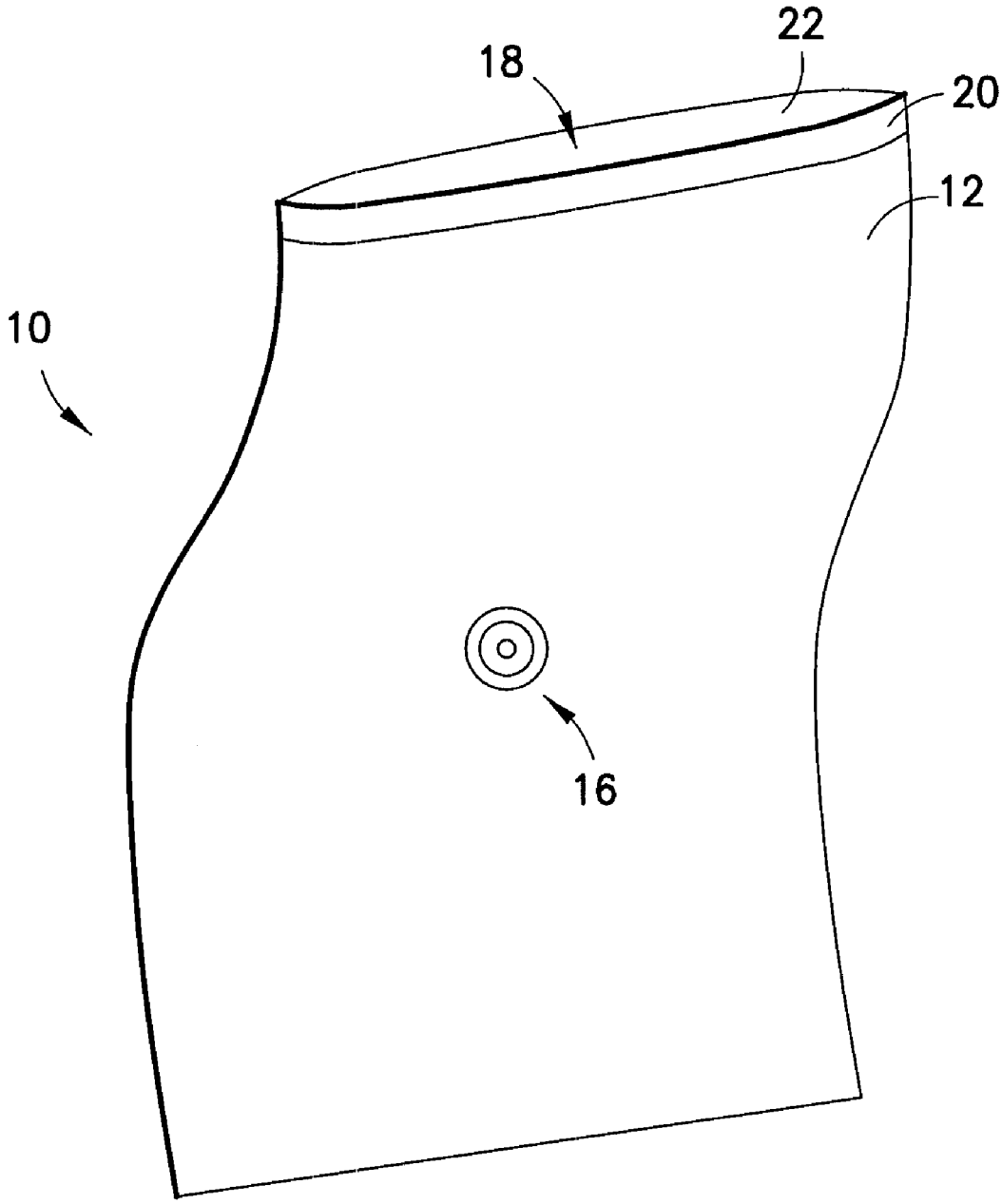
FIG. 1 is a drawing showing a front view of an evacuable storage bag having a valve and a zipper that can be hermetically sealed.

FIG. 1 is a generalized depiction of an evacuable storage bag 10 that comprises a front wall 12 and a rear wall (not visible in FIG. 1) formed by folding a sheet of bag-making film and then heat sealing the side edges of the front and rear walls to form a receptacle having an open mouth 18. Prior to folding, a valve assembly 16 is attached through an aperture formed in the sheet of bag-making film. Also a zipper assembly is attached to the film. This can be done in numerous ways. For example, one zipper part 20 could be attached to one margin of the film and then the web of film is folded. After folding, a margin of the folded-over portion of the film is attached to the other part 22 of the zipper assembly. Alternatively, a closed zipper assembly is placed between the opposing margins of a folded web and both zipper parts are sealed to the web in one operation. In either case, after zipper attachment, the side edges of the overlapping portions of bag-making film are heat sealed to form bag side seams. The ends of the zipper parts 20 and 22 can be crushed and fused together to form a zipper with joined ends. This operation can be performed in an operation separate from the side sealing operation.

Figure 2:
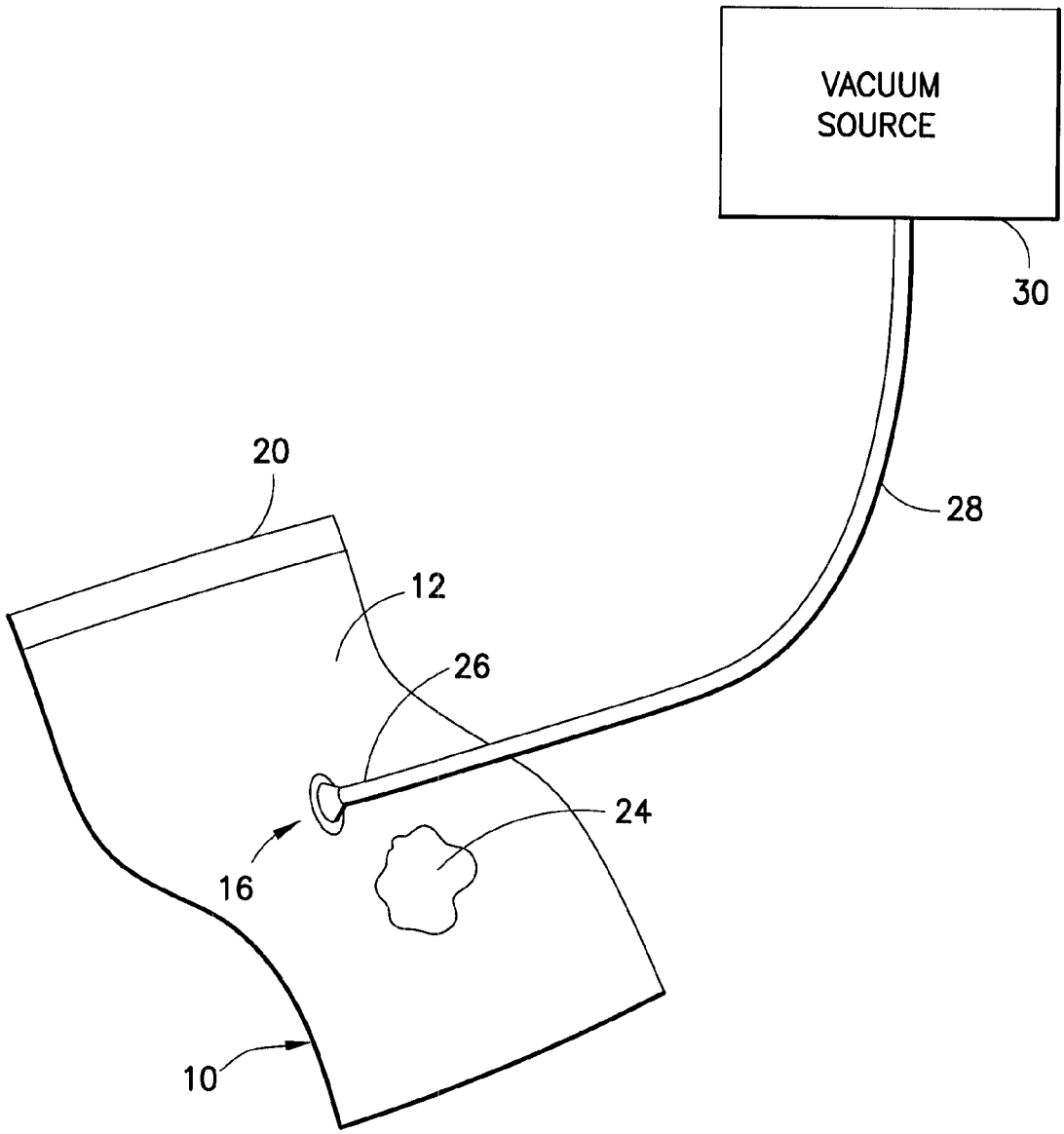
FIG. 2 is a drawing showing the storage bag of FIG. 1 connected to a vacuum source.

In the embodiment shown in FIG. 2, the valve assembly 16 is mounted in the front wall 12 so that an airtight seal is formed between the periphery of the valve assembly and the adjacent and surrounding peripheral edge of the aperture in the film. Any suitable valve assembly may be used. As seen in FIG. 2, the nozzle 26 is connected to an exhaust port of a vacuum source 30 (e.g., a vacuum pump) by means of a flexible tube 28. During evacuation, the interior of the bag is in fluid communication with the vacuum source 30 via the open valve of the valve assembly 16, the nozzle 26 and the flexible tube 28 connected in series. When the valve is open, the vacuum source 30 draws air from the interior of the bag, thereby forming a vacuum inside the bag. FIG. 2 shows an item 24 stored inside the evacuated bag. The stored item may be clothing, a book, or any other item that is best stored in an environment that will not expose the item to air or moisture. Also, evacuation allows the user to compress clothing or blankets to save space in storage.

Figure 3:
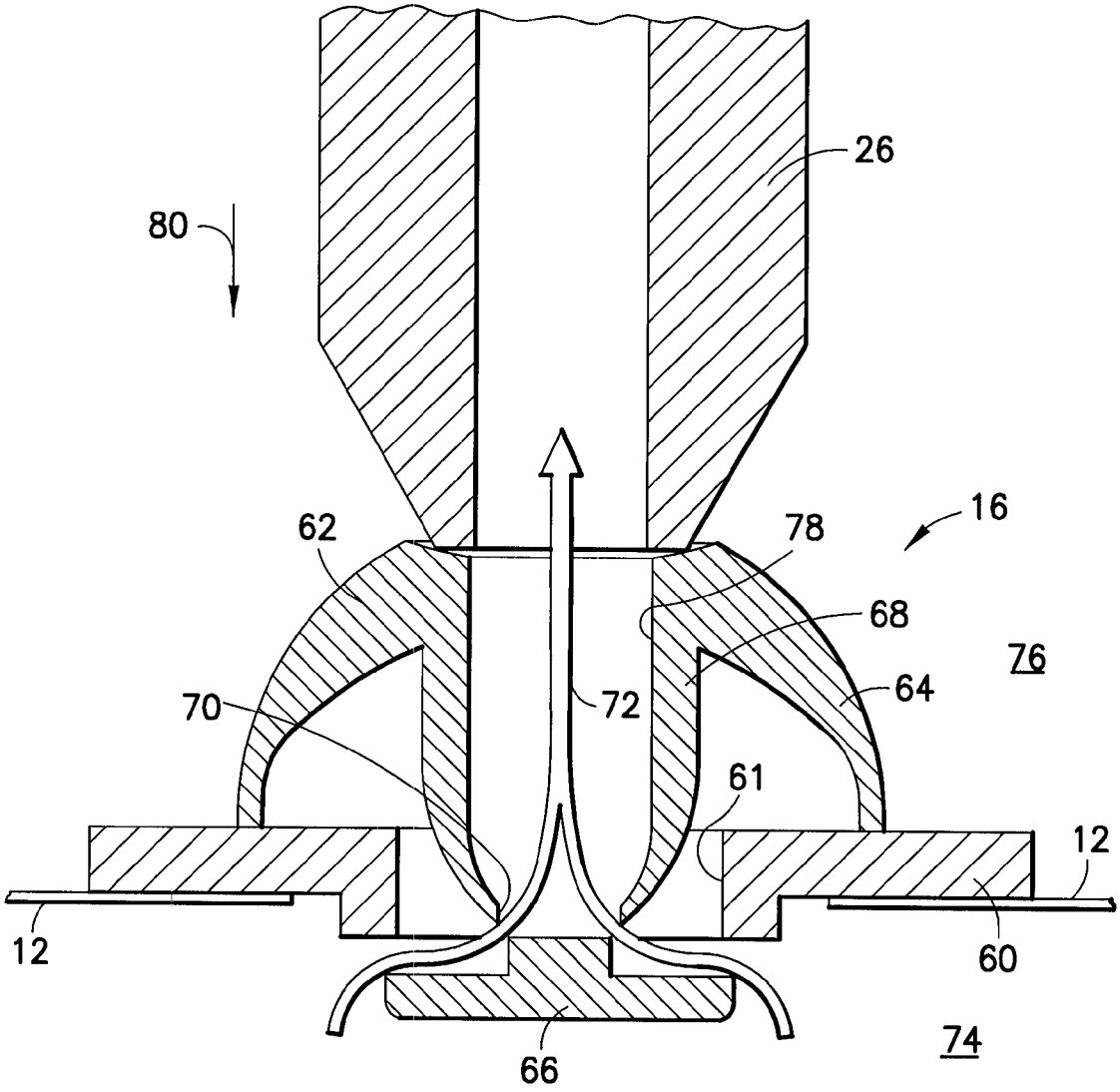
FIG. 3 is a drawing showing a sectional view of a valve assembly suitable for incorporation in the storage bags disclosed herein.

One example of a suitable valve assembly 16 is shown in FIG. 3. That valve assembly comprises a base 60 having a hole 61 therethrough and a contact surface disposed along a periphery of the hole, and further comprises a valve 62 coupled to the base for opening the hole in a first state and closing the hole in a second state. The valve 62 comprises a resilient cap 64 disposed on one side of the base 60, a gate 66 disposed on the other side of the base 60, and a stem 68 connecting the cap 64 to the gate 66. The cap 64 has an opening, the stem 68 has a cavity 69 in fluid communication with the opening in the cap 64 and at least one opening 70 in fluid communication with the cavity and an exterior of the stem 68, and the gate 66 is configured to contact the contact surface of the base 60 to close the hole 61 in the base when the cap 64 is in a first, i.e., undeformed, state and to separate at least partially from the surface to open the hole 61 in the base 60 at least partially when the cap 64 is in a second, i.e., deformed, state. When the cap 64 is deformed, the opening in the cap is in fluid communication with a space on the other side of the base 60 via the cavity 69 and the openings 70 in the stem.

Still referring to FIG. 3, the deformation of cap 64 is achieved by pressing the tip of a nozzle 26 against the cap of valve assembly 16 (in the direction indicated by arrow 80), causing the gate 66 to separate from the base 60, thereby allowing fluid communication between the interior 74 and the exterior 76 of the bag. The flow of air being sucked out of the storage bag is indicated by arrow 72. When the nozzle 26 is removed from the cap of the valve assembly 16, the cap recovers its undeformed shape (not shown in FIG. 3). The resilient force exerted by the cap 64 pulls the gate 66 upwards against the base 60, again forming an airtight seal.

The bag walls may be made of any flexible air-impermeable material, such as polyethylene film or nylon/polyethylene laminate. The components of the valve assembly may be formed by conventional injection molding, and may be formed of material such as polyethylene, polyvinylchloride, acrylonitrile-butadiene-styrene or other suitable material.

In order to maintain a vacuum inside the bag, however, it is necessary that the zipper of the reclosable bag also be hermetically sealed. The present invention is directed to structures for hermetically sealing the zipper as the bag is evacuated.

Figure 4:
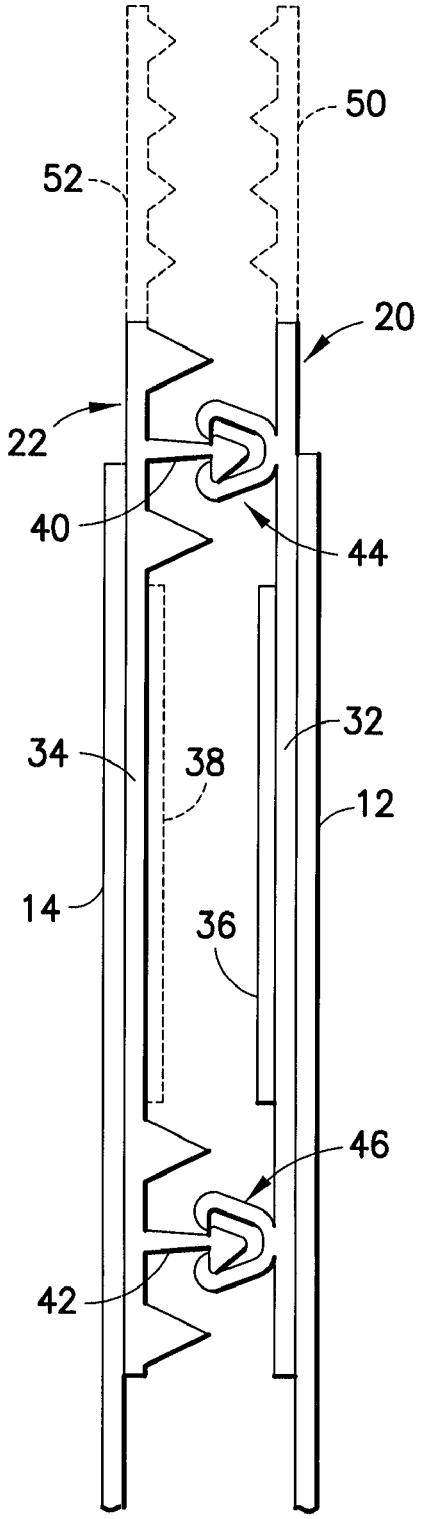
FIG. 4 is a drawing showing a sectional view of a zipper assembly in accordance with an embodiment of the invention disclosed in U.S. patent application Ser. No. 10/370,310.

One embodiment of a hermetically sealed zipper suitable for use in a vacuum storage bag is depicted in FIG. 4. It should be appreciated that this zipper is not drawn to scale. For example, the ratio of the width of the base strip to the thickness of the base strip may be greater than the ratio one would derive from measurement of the drawing.

As seen in FIG. 4, a package in accordance with this first embodiment comprises a receptacle comprising a front wall 12 and a rear wall 14. The upper marginal portions of walls 12 and 14 form a mouth of the receptacle. Although not shown in FIG. 4, a valve assembly (e.g., of the type shown in FIG. 3) penetrates the front wall 12. The valve assembly is operable (in the manner previously described) to allow the evacuation of air from the interior of the receptacle.

An extruded plastic zipper is installed in the mouth of the package. The zipper comprises a pair of interlockable fastener strips or zipper halves 20 and 22. In general, the interlocking profiles of the zipper halves may take any form. For example, the zipper may comprise interlocking rib and groove elements or alternating hook-shaped closure elements. Closure profiles of the rib-and-groove variety are used in the embodiment shown in FIG. 4. The rib may have any profile that can be retained by the opposing lips at the mouth of the groove, e.g., triangular, trapezoidal, semicircular, and so forth. As shown in FIG. 4, zipper part 20 comprises a base strip 32 and a pair of female closure profiles 44 and 46 that are mutually parallel and spaced apart, while zipper part 22 comprises a base strip 34 and a pair of male closure profiles 40 and 42 that are received in and interlock with the female closure profiles 44 and 46 respectively. The preferred zipper material is polyethylene. However, a different plastic material, such as polypropylene, could be used. Although not shown in FIG. 4, the zipper parts 20 and 22 are joined at opposite ends of the zipper, for example, by fusing the confronting ends of the zipper parts together by application of heat. Optionally, the ends of the zipper base strips are extended on the consumer side of the package to provide gripping strips 50 and 52, indicated by dashed lines in FIG. 4. Each gripping strip may be provided with a plurality of mutually parallel, spaced-apart ribs that facilitate gripping of the ends of the strips by the consumer. The consumer can then grasp the gripping strips 50 and 52 and then pull them apart to pry open the zipper.

The zipper part 20 is joined to the upper marginal portion of the front wall 12, and the zipper part 22 is joined to the upper marginal portion of the rear wall 14, e.g. by means of respective layers of sealant material (not shown in FIG. 4) laminated to the backs of the base strips. This is typically accomplished by co-extruding the zipper part and the sealant layer. The front and rear bag wall panels are respectively sealed to the zipper halves by heat fusion or welding (also referred to as "heat sealing"). Alternatively, the interlockable zipper halves can be attached to the wall panels by adhesive or bonding strips or the zipper profiles can be extruded integrally with the bag material. The walls of the bag may be formed of various types of thermoplastic material, such as low-density polyethylene, substantially linear copolymers of ethylene and a C3-C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive.

The zipper shown in FIG. 4 further comprises means for hermetically sealing the zipper. FIG. 4 shows two embodiments. In one embodiment, the hermetic sealing means comprise a layer 36 of pressure-sensitive adhesive material applied on base strip 32 as a coating on a central zone between the female profiles 44 and 46 (for this embodiment, ignore the layer 38 indicated by dashed lines). A pressure-sensitive adhesive is an adhesive that develops maximum bonding power when applied by a light pressure. The pressure-sensitive coating is applied to a portion of the zipper part that has been subjected to a corona treatment to enhance coating adhesion. The pressure-sensitive adhesive coating is continuously applied along the entire length of the zipper part 20. Although not shown in FIG. 4, the hermetic seal is achieved by pressing the base strips 32 and 34 together along the entire length of the central region between the closure profiles. When sufficient pressure is applied, the pressure-sensitive adhesive coating 36 will adhere to the confronting central region of the base strip 34 (this hermetically sealed state is not shown in FIG. 4), forming a hermetic seal along the entire length of the mouth of the package. When the zipper parts 20 and 22 are later pulled apart, the pressure-sensitive adhesive coating will peel away from the base strip 34 and will remain on the base strip 32. Alternatively, the pressure-sensitive adhesive coating could be applied on base strip 34 instead of base strip 32. The functionality of the hermetic seal would be the same in either case.

In accordance with an alternative embodiment of the invention, the hermetic sealing means comprise a layer 36 of cohesive material applied on base strip 32 as a coating on a central zone between the female profiles 44 and 46, and a layer 38 (indicated by dashed lines in FIG. 4) of cohesive material applied on base strip 34 as a coating on a central zone between the male profiles 40 and 42. A cohesive material is a tacky material that sticks with greater cohesive strength to itself than to other materials. The cohesive coatings are applied to portions of the zipper parts that have been subjected to a corona treatment to enhance coating adhesion. The cohesive coatings are continuously applied along the entire length of the zipper parts 20 and 22. Again, the hermetic seal is achieved by pressing the base strips 32 and 34 together along the entire length of the central region between the closure profiles. The coating 36 will cohere to the coating 38 (this cohesive state is not shown in FIG. 4), forming a hermetic seal along the entire length of the mouth of the package. When the zipper parts 20 and 22 are later pulled apart, the cohesive coatings will peel away from each other.

Figure 5:
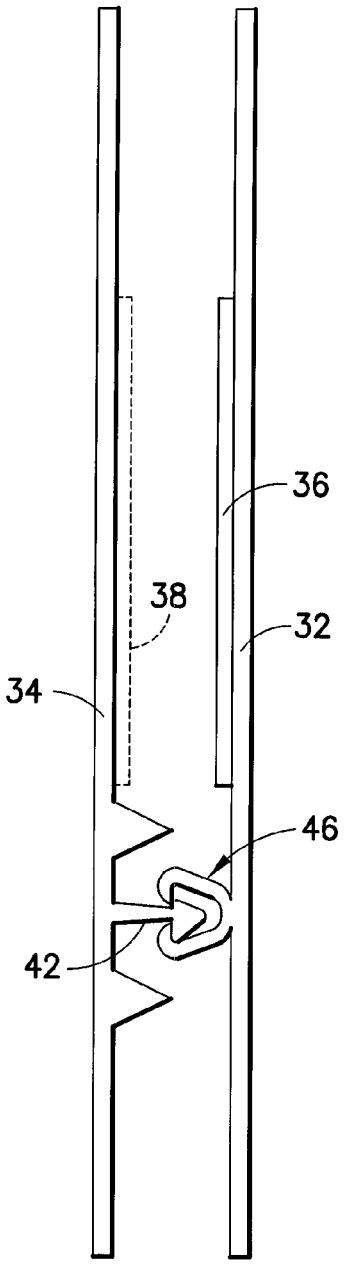
FIGS. 5-7 are drawings showing sectional views of zipper assemblies in accordance with other embodiments of the invention U.S. patent application Ser. No. 10/370,310.

To practice the present invention, it is not necessary to provide interlocking zipper profiles on both sides (i.e., the product side and the consumer side) of the hermetic seal. For example, the interlocked zipper profiles on the consumer side of the hermetic seal (profiles 40 and 44 in FIG. 4) can be eliminated, as seen in FIG. 5. In this case, the hermetic seal is disposed on the consumer side of the zipper profiles. The remaining elements bearing the same reference numerals used in FIG. 4 have the same functionality previously described.

In accordance with a further alternative embodiment not shown in the drawings, the interlocked zipper profiles on the product side of the hermetic seal (profiles 40 and 44 in FIG. 4) can be eliminated. In the latter case, the hermetic seal is disposed on the product side of the zipper profiles.

Figure 6:
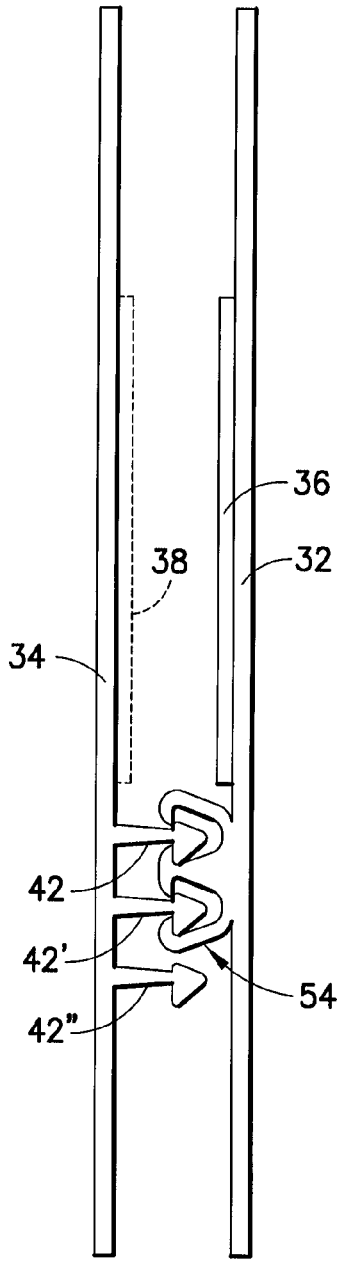

FIG. 6 shows an embodiment similar to the embodiment of FIG. 5, but having different zipper profiles. This embodiment employs a so-called "variable alignment" zipper. In this example, one zipper part comprises a trio of male closure profiles 42, 42' and 42", while the other zipper part comprises a dual female closure profile 54 having two grooves for receiving two of the three male closure profiles. As seen in FIG. 6, the male closure profiles 42 and 42'can be inserted in respective grooves formed in part by a common central leg with oppositely directed detents and by respective outer gripper jaws that cooperate with the central leg. Alternatively, full interlocking of the zipper profiles could be achieved by inserting male closure profiles 42' and 42" in the respective grooves of the dual female closure profile 54.

Figure 7:
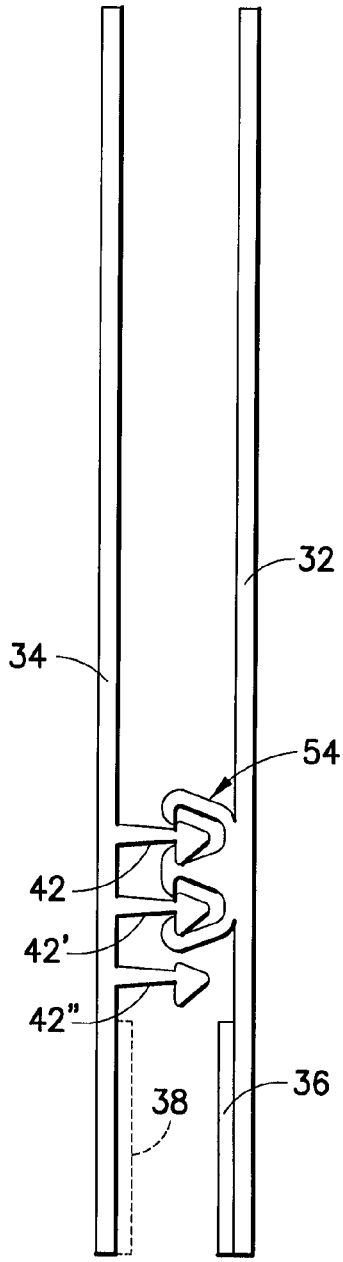

In FIG. 6 (as in FIG. 5), the hermetic sealing means (one or both of coatings 36 and 38) are applied to the zipper base strips 32 and 34 on the consumer side of the zipper profiles. In contrast, FIG. 7 shows an alternative embodiment wherein the hermetic sealing means are applied on the product side of the zipper profiles. The embodiment shown in FIG. 7 has a variable alignment zipper identical to that shown in FIG. 6.

In each of the embodiments shown in FIGS. 5-7, spaced ribs may provided on the distal portions of the zipper base strips, such ribbed distal portions serving as gripping strips of the type described with reference to FIG. 4.

A zipper part having a coating made of pressure-sensitive adhesive or cohesive material may be manufactured by co-extruding the zipper part to have a sealant layer on the exterior side, applying a corona treatment on the interior side of the zipper part, and then pulling the zipper part through a coater that applies a layer of pressure-sensitive adhesive or cohesive material of predetermined width onto the corona-treated side of the moving zipper part. The extruded zipper part comprises a base strip and a closure profile projecting from one side of the base strip. The coating is applied on a generally planar surface that extends longitudinally beside and in parallel with the closure profile. The corona treatment increases the adhesion of the coating to the zipper part, while the sealant layer facilitates joinder of the zipper part to the bag-making film.

Figure 8:
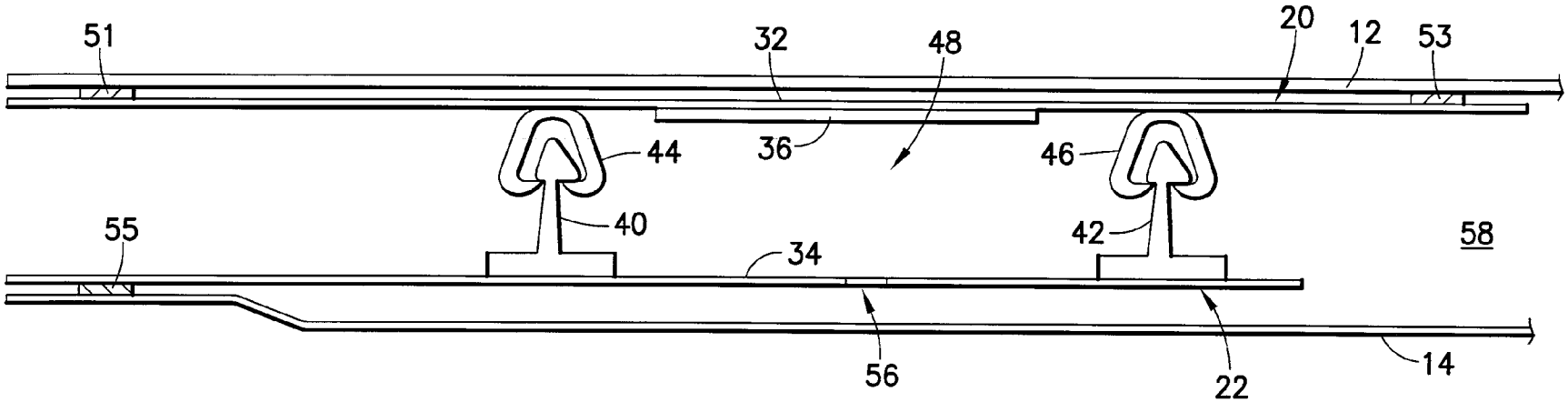
FIGS. 8 and 9 are drawings showing respective sectional views of a double zipper assembly joined to a mouth of a receptacle and provided with an adhesive coating for forming a hermetic seal in accordance with one embodiment of the invention.
Figure 9:
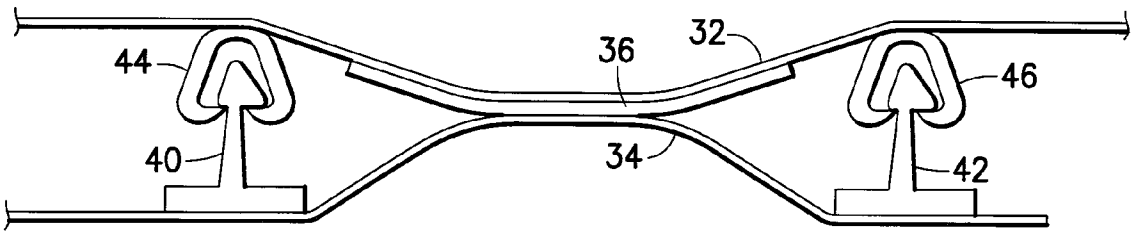

Another embodiment of a hermetically sealed zipper suitable for use in a vacuum storage bag is depicted in FIGS. 8 and 9. As seen in FIG. 8, a bag in accordance with this embodiment comprises a receptacle comprising a front wall 12 and a rear wall 14, which may be joined at the sides and connected at the bottom by a fold. The upper marginal portions of walls 12 and 14 form a mouth of the receptacle. Although not shown in FIG. 8, a valve assembly (e.g., of the type shown in FIG. 3) penetrates the front wall 12. The valve assembly is operable (in the manner previously described) to allow the evacuation of air from the interior of the receptacle after the article or matter to be stored has been placed inside the bag and the open mouth has been closed.

Still referring to FIG. 8, an extruded plastic double zipper is installed in the mouth of the bag. The double zipper comprises a pair of interlockable fastener strips or zipper parts 20 and 22, each zipper part having a pair of closure profiles, as previously described. Closure profiles of the rib-and-groove variety are used in the embodiment shown in FIG. 8.

As shown in FIG. 8, zipper part 20 comprises a base strip 32 and a pair of female closure profiles 44 and 46 that are mutually parallel and spaced apart, while zipper part 22 comprises a base strip 34 and a pair of male closure profiles 40 and 42 that are received in and interlock with the female closure profiles 44 and 46 respectively. Although not shown in FIG. 8, the zipper parts 20 and 22 are joined at opposite ends of the zipper, for example, by fusing the confronting ends of the zipper parts together by application of heat. After the article or matter to be stored has been placed inside the bag, the open mouth can be closed by pressing the respective pairs of complementary closure profiles together into interlocking relationship, as shown in FIG. 4. Alternatively, an inverted U-shaped clip (not shown) can be mounted on the double zipper. Such a clip is disclosed in U.S. patent application Ser. No. 10/910,724 filed on Aug. 3, 2004 and entitled "Evacuable Storage Bag Having Resealable Means Activated by Slider". The clip presses the incoming section of the double zipper together when moved in either direction. The mouth can be completely closed by sliding the clip from one end of the double zipper to the other.

The zipper part 20 is joined to the front wall 12 and the zipper part 22 is joined to the rear wall 14 by means of respective layers of sealant material (not shown in FIG. 4) laminated to the backs of the base strips. Alternatively, each zipper part can be attached directly to the bag walls without the sealant layer. The front and rear bag wall panels are respectively heat sealed to the zipper parts, as previously described.

In the example depicted in FIG. 8, the upper portion of bag wall 12 is joined to base strip 32 in a pair of band-shaped zones of joinder 51 and 53, which run parallel to the female closure profiles 44 and 46, whereas the upper portion of bag wall 14 is joined to base strip 34 in one band-shaped zone of joinder 55, which runs parallel to the male closure profiles 40 and 42. Alternatively, the interlockable zipper parts can be attached to the wall panels by adhesive or bonding strips. Although not shown in the drawings, the marginal portions of walls 12 and 14 may be heat sealed together to form side seams, the bottom portions of walls 12 and 14 may be connected at a fold (or sealed together), and the zipper strips may be joined together at the opposing ends of the zipper. The zipper end seals may take the form of rectangular zones, extending perpendicular to the closure profiles, in which the base strips are fused together and the closure profiles have been crushed by application of heat and pressure.

The zipper shown in FIG. 8 further comprises a layer 36 of low-tack adhesive material applied on base strip 32 as a coating (preferably of constant thickness) in a central zone between the female profiles 44 and 46, as previously described. The central zone of base strip 32, on which the adhesive layer 36 is applied, spans the space between the female closure profiles 44 and 46 and should be designed to flex inwardly when the interior space 48 (bounded by the zipper end seals at opposite ends of the zipper, by the closure profiles of the respective zippers and by the opposing central portions of the base strips 32 and 34) is evacuated. The same is true for the opposing central zone of base strip 34, which central zone spans the space between the bases of the male closure profiles 40 and 42. Inward flexing of the central portions of base strips 32 and 34 in response to evacuation of the intervening space 48 is shown in FIG. 9. The inwardly flexed portions of the base strips 32 and 34 are further designed so that the adhesive coating 36 on base strip 32 contacts and adheres to a portion of the confronting flexed central zone of base strip 34 along the entire length of the zipper (i.e., from one zipper end seal to the other) when the space 48 is evacuated, thereby hermetically sealing the mouth of the receptacle.

In accordance with various embodiments disclosed herein, the zipper interior space 48 is evacuated at the same time that the interior volume 58 of the receptacle is evacuated. The latter is accomplished via the above-described valve assembly. In accordance with the embodiment shown in FIGS. 8 and 9, evacuation of space 48 is facilitated by providing a multiplicity of evacuation holes 56 (only one of which is visible in FIGS. 8 and 9) that allow direct fluid communication between the zipper interior space 48 and the interior volume 58 of the receptacle. The embodiment depicted in FIGS. 8 and 9 has a single row of evacuation holes that are spaced at equal intervals, each hole being circular in shape. The first and last evacuation holes in the row are preferably near the respective zipper end seals. However, other arrays of evacuation holes could be used, including arrays comprising two or more rows of spaced-apart evacuation holes that are staggered relative to each other. Also, the evacuation holes may have a non-circular (e.g., elliptical or square) shape. To facilitate the flow of air out of interior space 48 during bag evacuation, the zone of web/zipper joinder 55 is disposed near the top of the base strip 34, providing a hinge for bag wall 14. The hinge construction also increases the resistance to the bag being opened by internal forces.

Alternatively, evacuation holes could be made in both legs of the female closure profile (instead of in base strip 34) to provide fluid communication between zipper interior space 48 and interior volume 58 of the receptacle. Optionally, additional evacuation holes could be formed in the male closure profile 42.

To break the hermetic seal and open the double zipper, the mutually confronting top portions of the zipper base strips 32 and 34 can be pried open and pulled apart, as previously described. The contents of the storage bag can then be removed through the open mouth.

The low-tack adhesive coating is continuously applied along the entire length of the double zipper. The adhesive must be designed to adhere to flexed base strip 34 under the pressure exerted by the ambient air outside the evacuated bag. When ambient pressure ambient air is applied, the low-tack adhesive coating 36 will adhere to the confronting central region of the base strip 34 (as shown in FIG. 9), forming a hermetic seal along the entire length of the mouth of the bag. When the zipper parts 20 and 22 are later pulled apart, the adhesive coating will peel away from the base strip 34 and will remain on the base strip 32. Alternatively, the adhesive coating could be applied on base strip 34 instead of base strip 32. The functionality of the hermetic seal would be the same in either case. However, this arrangement would require that the evacuation holes be formed after the layer of adhesive has been applied to the base strip 34. Alternatively, the base strip 34 can be sealed to bag wall 14 in two band-shaped zones of joinder and base strip 32 can be sealed to bag wall 12 in one band-shaped zone of joinder, with the evacuation holes being located on base strip 32.

Figure 10:
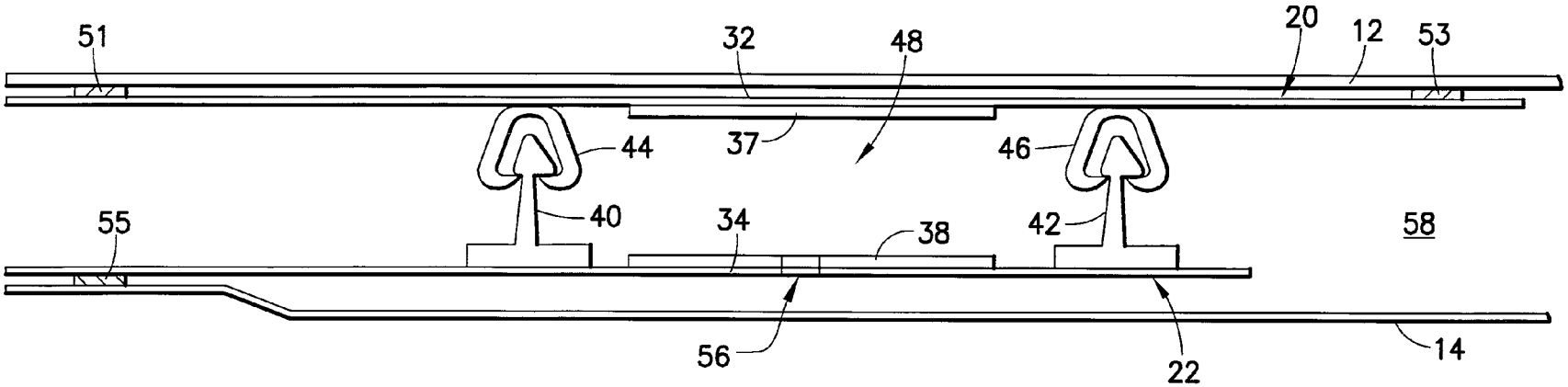
FIGS. 10 and 11 are drawings showing respective sectional views of a double zipper assembly joined to a mouth of a receptacle and provided with a pair of cohesive coatings for forming a hermetic seal in accordance with a second embodiment of the invention.
Figure 11:
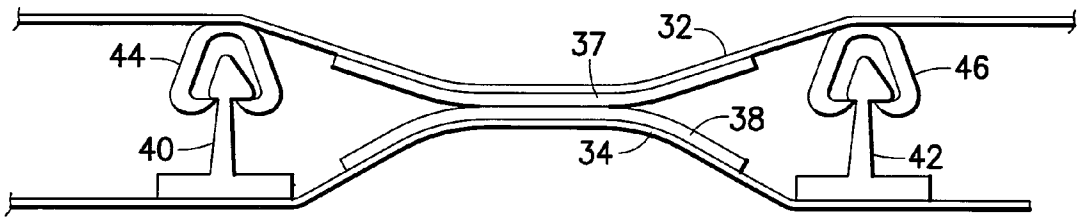

In accordance with an alternative embodiment of the invention shown in FIGS. 10 and 11, the hermetic sealing means comprise a layer 37 of cohesive material applied on base strip 32 as a coating in a central zone between the female profiles 44 and 46, and a layer 38 of cohesive material applied on base strip 34 as a coating in a central zone between the male profiles 40 and 42. The cohesive coatings are continuously applied along the entire length of the zipper parts 20 and 22. Again, the hermetic seal is achieved by evacuating the zipper interior space 48 in the manner previously described. The coating 37 will cohere to the coating 38 (this cohesive state is shown in FIG. 11), forming a hermetic seal along the entire length of the mouth of the bag. When the zipper parts 20 and 22 are later pulled apart, the cohesive coatings will peel away from each other.

A zipper part having a coating made of low-tack adhesive or cohesive material may be manufactured by co-extruding the zipper part to have a sealant layer on the exterior side, applying a corona treatment on the interior side of the zipper part, and then pulling the zipper part through a coater that applies a layer of adhesive or cohesive material of predetermined width onto the corona-treated side of the moving zipper part. The extruded zipper part comprises a base strip and a pair of spaced-apart, mutually parallel closure profiles projecting from one side of the base strip. The coating is applied on a generally planar surface disposed between the closure profiles, the coating extending in parallel with the closure profiles. The corona treatment increases the adhesion of the coating to the zipper part, while, if required, a sealant layer on the opposite side of the zipper part facilitates joinder of that zipper part to the bag-making film.

Figure 12:
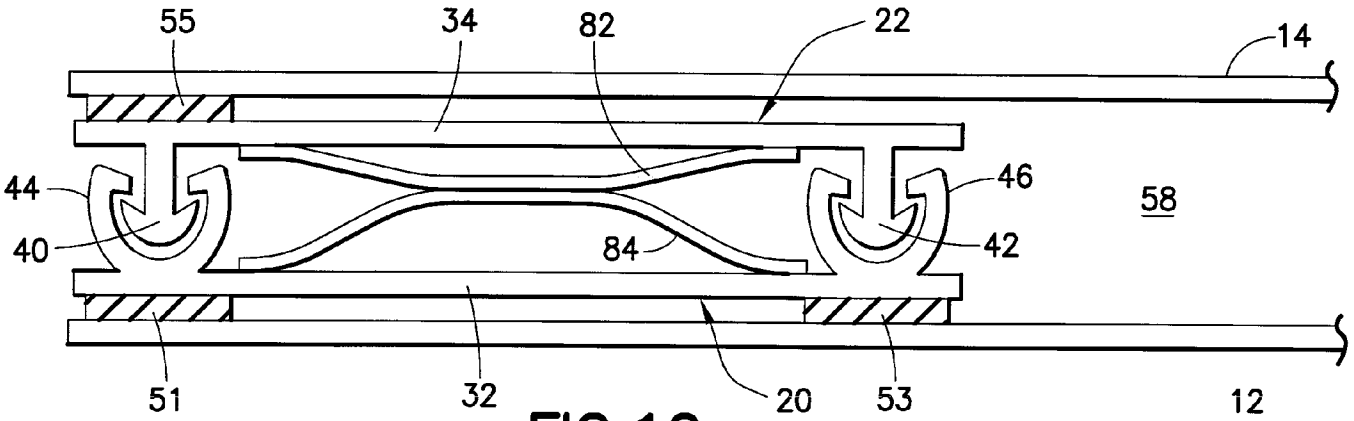
FIG. 12 is a drawing showing a sectional view of a double zipper assembly joined to a mouth of a receptacle in accordance with a third embodiment of the invention.

A zippered mouth of an evacuable storage bag in accordance with a further embodiment of the invention is shown FIG. 12, in which elements that are functionally equivalent to like elements shown in FIGS. 8 and 10 are designated by the same reference numerals. The bag partially shown in FIG. 12 again comprises walls 12 and 14 whose upper marginal portions form a mouth of the receptacle. A valve assembly (not shown in FIG. 12) penetrates the front wall 12. An extruded plastic double zipper is installed in the mouth of the bag. The double zipper comprises a pair of interlockable fastener strips or zipper parts 20 and 22, each zipper part having a pair of closure profiles similar to those previously described. Zipper part 20 comprises a base strip 32 and a pair of female closure profiles 44 and 46 that are mutually parallel and spaced apart, while zipper part 22 comprises a base strip 34 and a pair of male closure profiles 40 and 42 that are received in and interlock with the female closure profiles 44 and 46 respectively. Although not shown in FIG. 12, the zipper parts 20 and 22 are joined at opposite ends of the zipper. The upper portion of bag wall 12 is joined to base strip 32 in a pair of band-shaped zones of joinder 51 and 53, which run parallel to the female closure profiles 44 and 46, whereas the upper portion of bag wall 14 is joined to base strip 34 in one band-shaped zone of joinder 55, which runs parallel to the male closure profiles 40 and 42. The marginal portions of walls 12 and 14 may be heat sealed together to form side seams and their bottoms may be connected at a fold.

In the embodiment depicted in FIG. 12, cutouts (not shown) in the legs of the female closure profile 46 or in the male closure profile 42 (or in both) serve as evacuation holes, and a pair of flexible webs 82 and 84 respectively suspended from the base strips 32 and 34 serve as hermetic sealing means. More specifically, each flexible web 82 and 84 comprises a respective rectangular strip of cling film that extends along the length of the double zipper. Cling film is typically made from polyethylene or polyvinylchloride. A property of cling film is that it adheres to itself and other non-adherent surfaces. In the exemplary construction depicted in FIG. 12, one marginal portion of web 82 is joined to base strip 34 in a first band-shaped zone near and parallel to male profile 40 and the opposite marginal portion of web 82 is joined to base strip 34 in a second band-shaped zone near and parallel to male profile 42, while the unattached portion of web 82 intermediate the first and second zones of joinder is suspended therebetween. Similarly, one marginal portion of web 84 is joined to base strip 32 in a third band-shaped zone near and parallel to female profile 44 and the opposite marginal portion of web 84 is joined to base strip 32 in a second band-shaped zone near and parallel to female profile 46, while the unattached portion of web 84 intermediate the third and fourth zones of joinder is suspended therebetween. The ends of webs 82 and 84 are incorporated in the bag side seams (not shown). During the manufacturing process, the webs 82 and 84 must be joined to the respective zipper base strips before the double zipper is closed. The bag film can be joined to the base strips before or after the webs 82 and 84 are joined to the base strips.

When the interior volume of the bag partially depicted in FIG. 12 is evacuated via the aforementioned valve assembly (not shown), the interior space 48' bounded by the webs 82 and 84 and the double zippers, which communicates with the bag interior volume via the cutouts in female closure profile 46, is also evacuated. The pressure of the ambient atmosphere causes the portions of webs 82 and 84 on opposing sides of interior space 48' to come into contact and cling together, thereby forming a hermetic seal along the entire length of the double zipper. This hermetic seal helps maintain the vacuum inside the bag during storage.

Alternatively, each of webs 82 and 84 may be made of a non-adherent material, the confronting surfaces of the webs being coated with a cohesive material.

In accordance with a variant of the embodiment depicted in FIG. 12, only one web of cling film can be used. That web and the opposing base strip must be designed so that they contact each other and the cling film adheres to the opposing base strip when the interior space therebetween is evacuated. As previously described, the opposing base strip may be designed to flex inwardly and into contact with the solitary cling film as the interior space is evacuated. Alternatively, the solitary web may be made of a non-adherent material coated with a low-tack adhesive material that adheres to the opposing base strip when the bag is evacuated.

Figure 13:
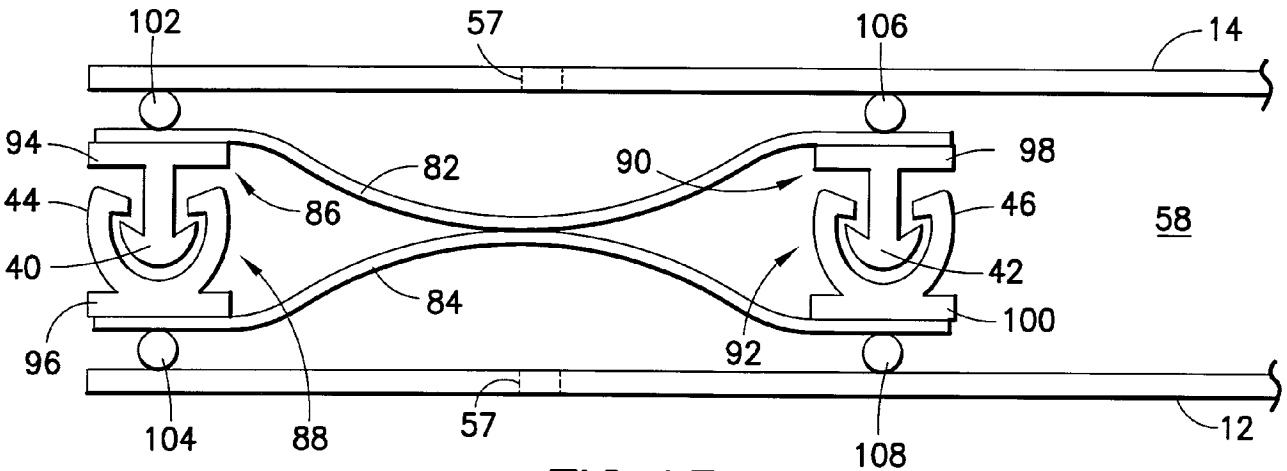
FIG. 13 is a drawing showing a sectional view of a double zipper assembly joined to a mouth of a receptacle in accordance with a fourth embodiment of the invention.

A zippered mouth of an evacuable storage bag in accordance with yet another embodiment of the invention is shown FIG. 13, in which elements that are functionally equivalent to like elements shown in FIG. 12 are designated by the same reference numerals. The bag partially shown in FIG. 13 again comprises walls 12 and 14 whose upper marginal portions form a mouth of the receptacle. A valve assembly (not shown in FIG. 13) penetrates the front wall 12. Instead of a double zipper having base strips, a pair of mutually parallel zippers are installed in the mouth of the bag. Each zipper comprises a respective pair of zipper parts 86, 88 and 90, 92. Zipper part 86 comprises a male closure profile 40 projecting from a base 94, while zipper part 88 comprises a female closure profile 44 projecting from a base 96, male closure profile 40 being interengaged with female closure profile 44 when the zipper is closed. Zipper part 90 comprises a male closure profile 42 projecting from a base 98, while zipper part 92 comprises a female closure profile 46 projecting from a base 100, male closure profile 42 being interengaged with female closure profile 46 when the zipper is closed. In this embodiment, the opposing marginal portions of flexible web 82 are joined to the backs of the respective bases 94 and 98, while the opposing marginal portions of flexible web 84 are joined to the backs of the respective bases 96 and 100, with the intermediate portions of webs 82 and 84 spanning the interior space between the zippers. The bag wall 12 is fused to the marginal portions of flexible web 84 by means of respective beads 104 and 108 made of sealant material that has been softened or melted and then cooled. Similarly, bag wall 14 is fused to the marginal portions of flexible web 82 by means of respective beads 102 and 106 made of sealant material that has been softened or melted and then cooled. The beads prevent burn-out of the flexible webs 82 and 84 during sealing of the bag walls thereto. Again the ends of the zipper parts of each zipper are joined. The bag walls and the flexible webs 82 and 84 are also joined together at the sides of the bag in the region between the zippers. Again cutouts are provided in the female closure profile 46 (or in the male closure profile 42 or in both) that allow communication between the interior volume 58 of the receptacle and the interior space 48 bounded by the flexible webs 82 and 84 and by the zippers. In addition, holes 57 are provided in the portions of the front and rear walls 12, 14 that confront the intermediate portions of the flexible webs 82, 84 are that freely suspended. As the interior volume 58 of the receptacle is evacuated via the valve assembly, the interior space 48 between the webs 82 and 84 is evacuated and air at ambient pressure enters the spaces between flexible web 82 and wall 14 and between flexible web 84 and wall 12. This causes the flexible webs 82, 84 to come into contact and cling to each other along the full length of the interior space, thereby forming a hermetic seal.

Figure 14:
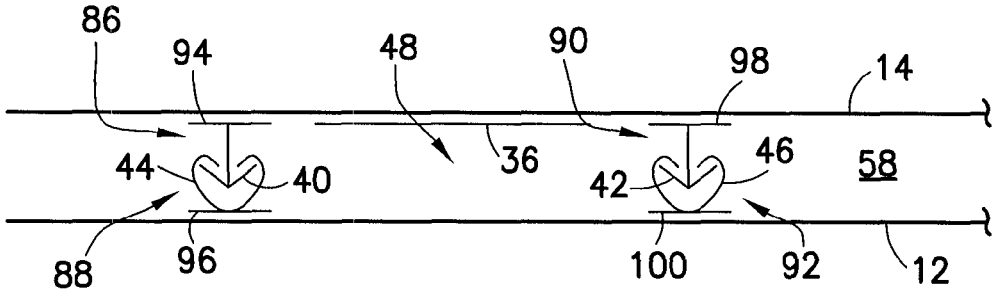
FIGS. 14 through 19 are drawings showing sectional views of respective zippered mouths of respective storage bags in accordance with further embodiments of the invention.

A zippered mouth of an evacuable storage bag in accordance with yet another embodiment of the invention is shown FIG. 14, in which elements that are functionally equivalent to like elements shown in FIG. 13 are designated by the same reference numerals. The bag partially shown in FIG. 14 again comprises walls 12 and 14 whose upper marginal portions form a mouth of the receptacle. A valve assembly (not shown in FIG. 14) penetrates the front wall 12. A pair of mutually parallel zippers are installed in the mouth of the bag. Each zipper comprises a respective pair of zipper parts 86, 88 and 90, 92. In this embodiment, mutually parallel band-shaped portions of the rear wall 14 are joined to the backs of the respective bases 94 and 98, while mutually parallel band-shaped portions of the front wall 12 are joined to the backs of the respective bases 96 and 100, with the intermediate portions of the walls 12 and 14 spanning the interior space between the zippers. Again the ends of the zipper parts of each zipper are joined. The bag walls 12 and 14 are also joined together at the sides of the bag in the regions between the zippers (and above and below the zippered mouth of the receptacle), and are joined to the zippers in the regions where the ends of the zippers are joined to each other. The storage bag partly shown in FIG. 14 further comprises a layer 36 of low-tack adhesive material applied on the rear wall 14 as a coating (preferably of constant thickness) in a zone between the male profiles 86 and 90. (Alternatively, the low-tack adhesive material could be applied on the front wall 12.) The material of the bag walls is sufficiently flexible that the zone of rear wall 14 on which the adhesive layer 36 is applied and the opposing zone of front wall 12 each flex inwardly when the interior space 48 (bounded by the zipper end seals at opposite ends of the zipper, by the closure profiles of the respective zippers and by the opposing portions of the bag walls) is evacuated. The higher pressure on the outside of the bag pushes the two flexible wall portions together. When bag walls on opposing sides of interior space 48 flex inward, the adhesive coating 36 on one wall adheres to the confronting portion of the other wall along the entire length of the zipper (i.e., from one zipper end seal to the other), thereby hermetically sealing the mouth of the receptacle.

Figure 15:
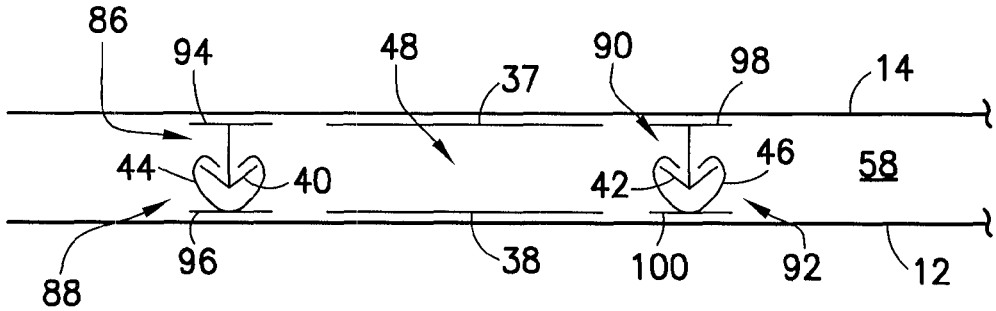

In accordance with a further embodiment depicted in FIG. 15, layers 37 and 38 of cohesive material are respectively applied on the portions of the rear and front walls 14 and 12 intermediate the zippers. Again the material of the bag walls is sufficiently flexible that the zone of rear wall 14 on which the cohesive layer 37 is applied and the opposing zone of front wall 12 on which the cohesive layer 38 is applied each flex inwardly when the interior space 48 is evacuated. The higher pressure on the outside of the bag pushes the two flexible wall portions together. When the inwardly flexed portions of the bag walls on opposing sides of interior space 48 contact each other, the cohesive coating on one wall coheres to the confronting cohesive coating on the other wall along the entire length of the zipper (i.e., from one zipper end seal to the other), thereby hermetically sealing the mouth of the receptacle.

Figure 16:
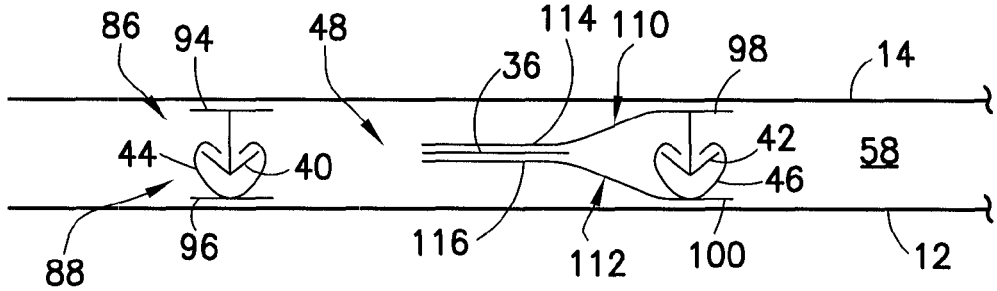

A zippered mouth of an evacuable storage bag in accordance with another embodiment of the invention is shown FIG. 16, in which elements that are functionally equivalent to like elements shown in FIG. 14 are designated by the same reference numerals. In this embodiment, the second zipper is replaced by a zipper comprising a pair of zipper parts 110, 112 having respective extension flanges 114, 116 that form a seal that extends into the interior space 48. Zipper part 110 comprises a male closure profile 42 projecting from a base 98, while zipper part 92 comprises a female closure profile 46 projecting from a base 100. One end of extension flange 114 is connected to one end of base 98, while one end of extension flange 116 is connected to one end of base 100. Preferably, the thickness of the extension flanges is less than or equal to the thickness of the bases. One of the extension flanges 114, 116 has a coating 36 of low-tack adhesive material on the surface that confronts the other extension flange. The ends of the extension flanges are captured in and restrained by the side seams of the receptacle (not shown in FIG. 16). When the interior volume 58 of the receptacle is evacuated, air in the interior space 48 leaks between the male and female closure profiles 42 and 46 and into the evacuated interior volume, causing the interior space 48 to be evacuated. The pressure of the ambient air outside the bag pushes the bag wall portions bounding the interior space 48 together, thereby also pushing the extension flanges 114, 116 toward each other. When the adhesive coating 36 contacts and adheres to the opposing extension flange, the mouth of the receptacle is hermetically sealed. FIG. 16 depicts the state wherein after the mouth has been hermetically sealed, the leakage of ambient air through the zipper parts 86 and 88 pushes apart the bag wall portions bounding the interior space 48.

Figure 17:
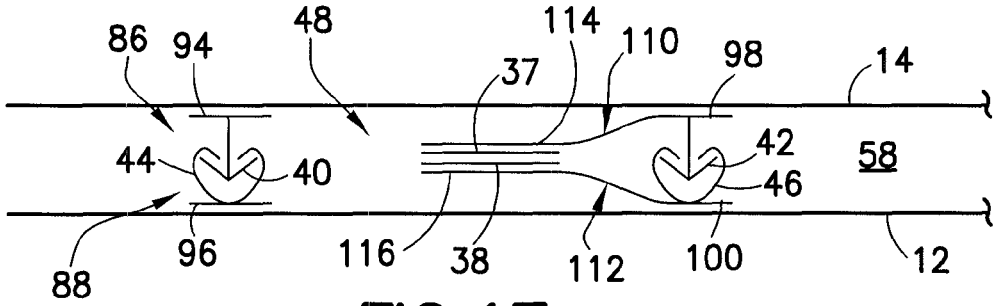

The embodiment depicted in FIG. 17 differs from that shown in FIG. 16 in that each extension flange 114, 116 is coated with cohesive material 37, 38 respectively, instead of an adhesive coating being applied to only one extension flange. When the extension flanges are pressed together by ambient air pressure during bag evacuation, the cohesive coatings contact and cohere to each other, thereby hermetically sealing the mouth of the receptacle.

Figure 18:
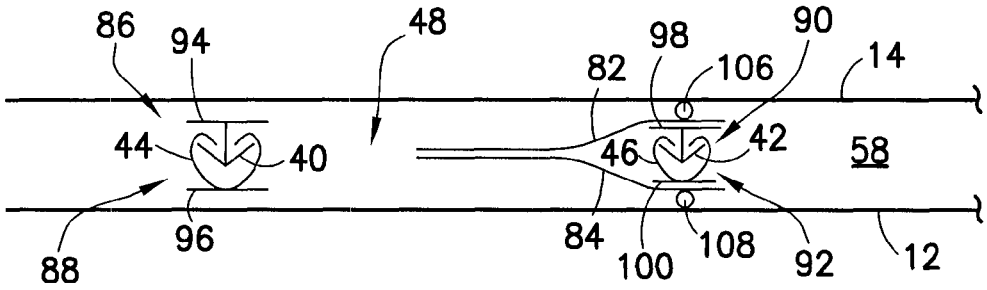

In accordance with a further embodiment depicted in FIG. 18, the extension flanges are made of cling film. The bag partially shown in FIG. 18 again comprises walls 12 and 14 whose upper marginal portions form a mouth of the receptacle. A valve assembly (not shown in FIG. 18) penetrates the front wall 12. Again, a pair of mutually parallel zippers are installed in the mouth of the bag. Each zipper comprises a respective pair of zipper parts 86, 88 and 90, 92. Zipper part 86 comprises a male closure profile 40 projecting from a base 94, while zipper part 88 comprises a female closure profile 44 projecting from a base 96. Zipper part 90 comprises a male closure profile 42 projecting from a base 98, while zipper part 92 comprises a female closure profile 46 projecting from a base 100. In this embodiment, a marginal portion of a strip-shaped flexible web 82 is joined to the back of the base 98, while an opposing marginal portion of a strip-shaped flexible web 84 is joined to the back of the base 100. The ends of the webs 82 and 84 are incorporated in the side seams of the bag, with intermediate portions of webs 82 and 84 spanning part of the interior space between the zippers. The bag wall 12 is fused to the marginal portion of flexible web 84 by means of a bead 108 made of sealant material that has been softened or melted and then cooled. Similarly, bag wall 14 is fused to the marginal portion of flexible web 82 by means of a bead 106 made of sealant material that has been softened or melted and then cooled. Again the ends of the zipper parts of each zipper are joined. When the interior volume 58 of the receptacle is evacuated via the valve assembly, the flexible webs 82 and 84 will come into contact and cling to each other along the full length of the interior space, thereby forming a hermetic seal.

In the embodiments depicted in FIGS. 13 through 18, cutouts (not shown) may be provided in the legs of the female closure profile 46 or in the male closure profile 42 (or in both) to serve as evacuation holes, that is, holes for facilitating the evacuation of the interior space 48 between the zippers.

Figure 19:
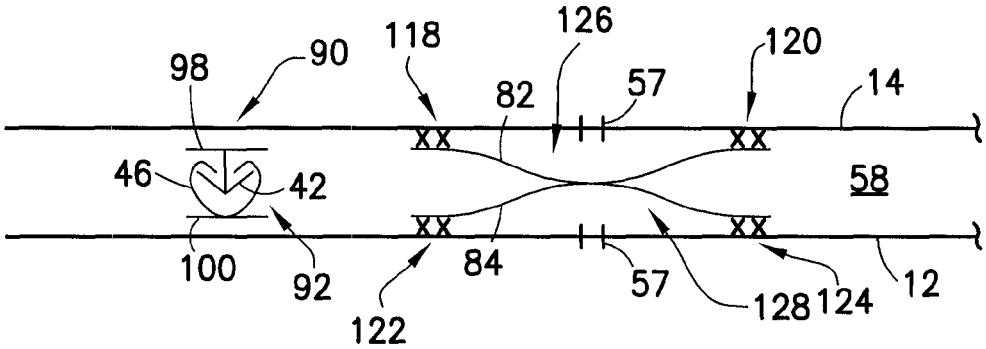
Figure 20:
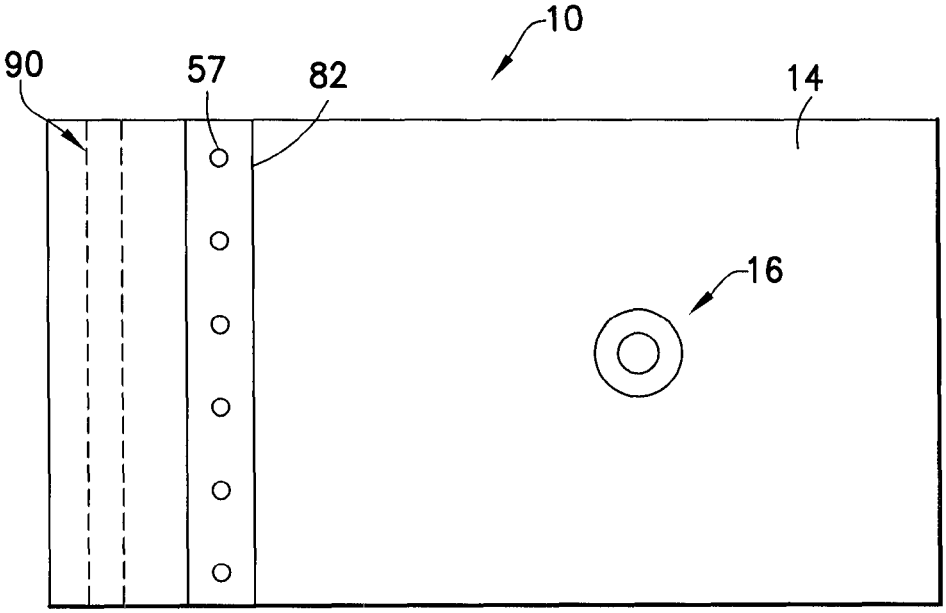
FIG. 20 is a drawing showing a plan view of the storage bag partly shown in FIG. 19.

Yet another embodiment is depicted in FIGS. 19 and 20. In accordance with this embodiment, a pair of strip-shaped flexible webs 82 and 84 for hermetically sealing the mouth of the receptacle. The webs 82 and 84 are disposed between the zipper (comprising zipper parts 90 and 92 as previously described) and the portion of the interior volume 58 of the receptacle in which the stored article or goods must be placed. Each flexible web 82, 84 comprises a respective rectangular strip of cling film that extends across the full width of the bag. In the exemplary construction depicted in FIG. 19, respective marginal portions of web 82 are joined to the rear wall 14 in respective band-shaped zones 118, 120 that are parallel to and spaced apart from each other, and opposing marginal portions of web 84 are joined to the front wall 12 in respective band-shaped zones 122, 124 that are parallel to and spaced apart from each other. The ends of the webs 82, 84 are incorporated in the side seams of the storage bag. The unattached portions of webs 82 and 84 are suspended from the surrounding attached perimeters. In addition, holes 57 are formed in the portion of the front wall 12 between the zones 122, 124 of joinder with web 84 and in the portion of the rear wall 14 between the zones 118, 120 of joinder with web 82. In the implementation depicted in FIG. 20, a line of spaced apart holes 57 is provided in rear wall 14 to allow fluid communication between the interior space 126 (bounded by rear wall 14 and web 82) and the ambient atmosphere, and another line of spaced apart holes 57' is provided in front wall 12 to allow fluid communication between the interior space 128 (bounded by front wall 12 and web 84) and the ambient atmosphere.

The bag depicted in FIGS. 19 and 20 can be used in the following manner. First, the user opens the zipper, inserts the article or goods to be stored inside the interior volume 58 of the receptacle, and then closes the zipper. Then the valve assembly 16 is connected to a vacuum source. The interior volume 58 is then evacuated. Initially the webs 82 and 84 of cling film are separated, but as the pressure inside the interior volume 58 decreases, the ambient pressure causes air to enter interior spaces 126 and 128 via holes 57 and 57'. The pressure differential across the webs 82 and 84 pushes them into contact along the entire width of the receptacle. The contacting portions of webs 82 and 84 cling together to hermetically seal the mouth of the receptacle. This hermetic seal helps maintain the vacuum inside the bag during storage.

Alternatively, webs 82 and 84 may be replaced by flexible webs made of a non-adherent material, the confronting surfaces of the webs being coated with a cohesive material or one of the confronting surfaces of webs being coated with a low-tack adhesive material. For example, such flexible webs may comprise linear low-density polyethylene (LDDP) stretch wrapping film coated with tackifier. Alternatively, the tackifier may be blended with the LDDP resin before extrusion, the tackifier migrating to the surface of the film after extrusion.

In accordance with a further aspect of the invention, the flexible webs 82 and 84 may be made of a material having a semi-liquid surface that will act as a caulk or liquid so that it is self-sealing or flowable to create an air lock and have low permeability. Also the material should not separate or crack when folded, and should not dry up over a desired minimum period of time. In addition, fabric must not stick to the surface. For certain applications, vinyl with plasticizers or unvulcanized latex may be used.

As disclosed above, the bag material, the zipper base strips or flexible webs suspended from the bag material or from the zipper base strips may be treated with a sealant material such as a tackifier. In such cases, not only will the sealant act as a gas barrier, but also it will provide cohesion to hold the strips together semi-mechanically.

In each of the embodiments disclosed hereinabove, the zippers, sealant beads, cling films, and adhesive and cohesive coatings extend the full width of the storage bag. Likewise the zones in which any of those components are joined to each other or to the bag wall extend the full width of the bag.

In cases where the flat resealable means are placed between two parallel zippers, the flat resealable means may be sealed by operation of the slider as disclosed in previously cited U.S. patent application Ser. No. 10/910,724, the disclosure of which is fully incorporated by reference herein. This could be done before the interior volume of the storage bag is evacuated.

The advantages of providing a flat valve for hermetically sealing an evacuated storage bag (or a closure thereof) are manifold. The flat valve provides a barrier to prevent ambient air from leaking into the evacuated interior volume of the bag. A flat valve will be less susceptible to channel leaking or damage when the bag is folded over on itself, particularly if each membrane is as thin as tackified stretch film having a thickness of ½ mil. Also a thin and wide flat valve will create a more tortuous path for channel leakers caused by wrinkling during use.

In addition, a flat valve will be easy to install because the length of the flat valve is in the machine direction during bag production. Also, due to the thin gauge of the film used to make the flat valve, it will be easy to seal across the bag making film during cross sealing. This will be true even if the zipper(s) is/are incorporated into the flat valve. However, it may be necessary to pre-stomp the flat valve prior to welding it to the bag making film in the machine direction.

Additional sealant development and improvement of the materials for the flat valve can be explored separately from the bag making film, thus avoiding additional cost of the bag making material.

A person skilled in the art will appreciate that means other than the one-way valve assembly depicted in FIG. 3 may be employed to evacuate the interior of the storage bag. For example, instead of a one-way valve assembly installed in the wall of the bag, the bag may be evacuated using a flat one-way valve located in a side seam or the bottom seam of the bag. Such a flat one-way valve can allow the air inside the bag to escape when the bag is compressed by rolling it up. When used in this way, a vacuum occurs inside the bag when it is unrolled as the contents try to expand. A flat one-way valve that is suitable for this purpose is disclosed in U.S. Pat. No. 6,729,473.

Figure 21:
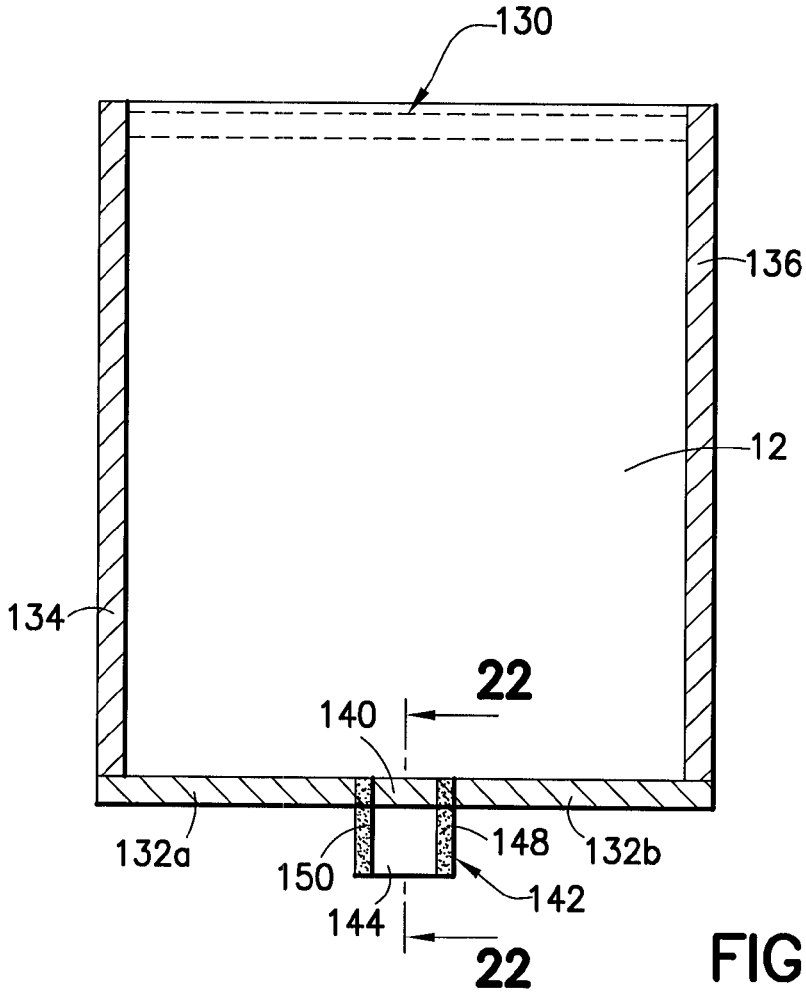
FIG. 21 is a drawing showing a plan view of a storage bag in accordance with another embodiment of the invention.
Figure 22:
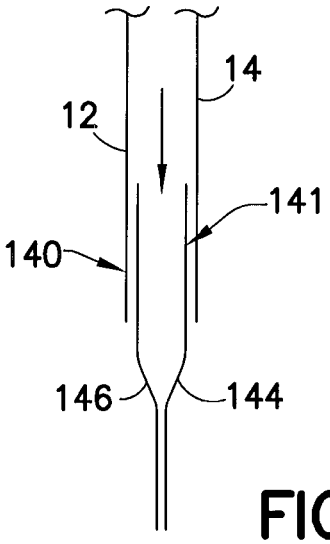
FIG. 22 is a drawing showing a sectional view, the section being taken along line 22-22 indicated in FIG. 21.

An alternative embodiment is shown in FIGS. 21 and 22. FIG. 21 shows a bag comprising a receptacle, a closure and means for hermetically sealing the closure (including, but not limited to, any one of the specific embodiments shown in FIGS. 4-19). The boundaries of a hermetically sealed closure assembly 130, installed in the mouth of the receptacle, are indicated by dashed lines in FIG. 21. The vertical hatched zones along the side margins represent respective side seams 134 and 136. The horizontal hatched zone along the bottom of the bag represents a bottom seam having a construction that varies across the bag. The hatched zones 132*a* and 132*b* represent zones where the front wall 12 is joined to the rear wall (not visible in FIG. 21), zones 132*a* and 132*b* extending on opposite sides of a duck bill valve 142, which is captured in the bottom seam.

FIG. 22 is a sectional view taken through the duck bill valve 142 along line 22-22 indicated in FIG. 21. As seen in FIG. 22, the duck bill valve 142 comprises two panels 144 and 146 made of film material. As shown in FIG. 22, the duck bill valve 142 is attached to the receptacle by joining the valve panel 144 to the rear wall 14 in a zone 141 and by joining the valve panel 146 to the front wall 12 in a zone 140, both zones of joinder forming respective portions of the bottom seam. The valve panels 144 and 146 are joined to each other in vertical speckled zones that represent respective valve side seams 150 and 148, seen in FIG. 21. The valve panels 144 and 146 are not joined to each other in the region between the valve side seams 148 and 150. Thus, the portions of the valve panels 144 and 146 spanning the valve side seams define a flat channel through which air inside the interior volume of the receptacle can escape into the ambient atmosphere until the interior volume is fully or partially evacuated. In this embodiment, all seams are formed by conventional conductive heat sealing.

For the purpose of illustration, the duck bill valve 142 in FIGS. 21 and 22 is shown extended from the bottom of the bag. In a commercial product, however, it would be advantageous to assemble the duck bill valve further inside the receptacle to protect it during usage. The outside of the duck bill valve 142 is welded to the inside of the packaging in the bottom seal area. The inside surfaces of the valve should not be welded together. This can be accomplished by placing an insert in the valve when it is welded in place or by making the valve from a film laminate wherein the inner surfaces of the valve are formed by respective layers of a non-sealant polymeric material having a melting temperature higher than the melting temperature of the packaging film.

FIG. 21 shows a duck bill valve attached to the bottom of the bag. However, the duck bill valve 142 can alternatively be located along the side seams or at a corner of the bag. In this form, the air can be forced out the valve (by rolling the bag) or a tube can be inserted to draw the air out using a vacuum cleaner.

In accordance with a further alternative to the one-way valve assembly shown in FIG. 3, a bag could be filled and rolled up from the bottom toward the zipper opening before the zipper is completely closed. The air is forced out of the bag through the zipper opening before the zipper is completely closed, i.e., before the flat resealable means are resealed. This embodiment does not require a one-way valve separate from the flat resealable means.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip or sealant layer or bead, etc.

The invention claimed is:

1. A bag comprising:

a receptacle having an interior volume and a mouth, said receptacle comprising first and second walls made of flexible material, said first and second walls being joined to each other along first and second side edges thereof to form first and second side seams and being joined or connected to each other along a bottom of said receptacle;

a first zipper made of plastic material and installed in said mouth, said first zipper comprising first and second mutually interlockable zipper parts joined to each other at opposite ends of said first zipper;

a first web of film comprising a first longitudinal portion joined to a first band-shaped zone of said first wall, and first and second ends incorporated in said first and second side seams, respectively, said first band-shaped zone of said first wall being disposed between said bottom edge of said receptacle and said first zipper; and a second web of film comprising a first longitudinal portion joined to a first band-shaped zone of said second wall, and first and second ends incorporated in said first and second side seams, respectively, said first band-shaped zone of said second wall being disposed between said bottom edge of said receptacle and said first zipper, wherein respective unattached portions of the first and second webs come into contact continuously from said first side seam to said second side seam when said interior volume is evacuated, and wherein said first web further comprises a second longitudinal portion joined to a second band-shaped zone of said first wall so that said first web is joined to said first wall along its entire perimeter, and said first wall has at least one hole located within said perimeter of said first web, and said second web further comprises a second longitudinal portion joined to a second band-shaped zone of said second wall so that said second web is joined to said second wall along its entire perimeter, and said second wall has at least one hole located within said perimeter of said second web.

2. The bag as recited in claim 1, further comprising a second zipper made of plastic material, said second zipper comprising first and second mutually interlockable zipper parts joined to each other at opposite ends of said second zipper, said first zipper part of said second zipper being joined to said first longitudinal portion of said first web and said second zipper part of said second zipper being joined to said first longitudinal portion of said second web, and wherein said first zipper part of said first zipper is joined to said second longitudinal portion of said first web and said second zipper part of said first zipper is joined to said second longitudinal portion of said second web.

3. The bag as recited in claim 1, further comprising a valve assembly installed in a hole in said first wall for evacuating air from said interior volume.

4. The bag as recited in claim 1, wherein said film has the property that it adheres to itself and to non-adherent surfaces.

5. A bag comprising:

a receptacle having an interior volume and a mouth, said receptacle comprising first and second walls made of flexible material, said first and second walls being joined to each other along first and second side edges thereof to form first and second side seams and being joined or connected to each other along a bottom of said receptacle;

a first zipper made of plastic material and installed in said mouth, said first zipper comprising first and second mutually interlockable zipper parts joined to each other at opposite ends of said first zipper;

a first web of film comprising a first longitudinal portion joined to a first band-shaped zone of said first wall, and first and second ends incorporated in said first and second side seams, respectively, said first band-shaped zone of said first wall being disposed between said bottom edge of said receptacle and said first zipper;

a second web of film comprising a first longitudinal portion joined to a first band-shaped zone of said second wall, and first and second ends incorporated in said first and second side seams, respectively, said first band-shaped zone of said second wall being disposed between said bottom edge of said receptacle and said first zipper; and a second zipper made of plastic material, said second zipper comprising first and second mutually interlockable zipper parts joined to each other at opposite ends of said second zipper, said first zipper part of said second zipper being joined to said first longitudinal portion of said first web and said second zipper part of said second zipper being joined to said first longitudinal portion of said second web, wherein respective unattached portions of the first and second webs come into contact continuously from said first side seam to said second side seam when said interior volume is evacuated.

6. A bag comprising:

a receptacle having an interior volume and a mouth, said receptacle comprising first and second walls made of flexible material, said first and second walls being joined to each other along first and second side edges thereof to form first and second side seams and being joined or connected to each other along a bottom of said receptacle;

a first zipper made of plastic material and installed in said mouth, said first zipper comprising first and second mutually interlockable zipper parts joined to each other at opposite ends of said first zipper;

a first web of film comprising a first longitudinal portion joined to a first band-shaped zone of said first wall, and first and second ends incorporated in said first and second side seams, respectively, said first band-shaped zone of said first wall being disposed between said bottom edge of said receptacle and said first zipper;

a second web of film comprising a first longitudinal portion joined to a first band-shaped zone of said second wall, and first and second ends incorporated in said first and second side seams, respectively, said first band-shaped zone of said second wall being disposed between said bottom edge of said receptacle and said first zipper; and a second zipper made of plastic material and comprising first and second mutually interlockable zipper parts joined to each other at opposite ends of said second zipper and joined to said first longitudinal portions of said first and second webs respectively, said first and second zippers being generally parallel and separated by a distance, wherein unattached portions of the first and second webs within their respective perimeters come into contact continuously from said first side seam to said second side seam when said interior volume is evacuated.

7. The bag as recited in claim 6, wherein said first web further comprises a second longitudinal portion joined to a second band-shaped zone of said first wall so that said first web is joined to said first wall along its entire perimeter; said first wall has at least one hole located within said perimeter of said first web; said second web further comprises a second longitudinal portion joined to a second band-shaped zone of said second wall so that said second web is joined to said second wall along its entire perimeter; said second wall has at least one hole located within said perimeter of said second web; and said first zipper part of said first zipper is joined to said second longitudinal portion of said first web and said second zipper part of said first zipper is joined to said second longitudinal portion of said second web.

8. The bag as recited in claim 6, further comprising a valve assembly installed in a hole in said first wall for evacuating air from said interior volume.

9. The bag as recited in claim 6, wherein said film has the property that it adheres to itself and to non-adherent surfaces.

10. A bag comprising:

a receptacle having an interior volume and a mouth, said receptacle comprising first and second walls made of flexible material, said first and second walls being joined to each other along first and second side edges thereof to form first and second side seams and being joined or connected to each other along a bottom of said receptacle;

a dual zipper comprising first and second mutually interlocked zipper parts joined at opposite ends of said zipper, said first zipper part comprising a first base strip and first and second closure profiles projecting from one side of said first base strip, said first and second closure profiles being parallel to and spaced apart from each other, and said second zipper part comprising a second base strip and third and fourth closure profiles projecting from one side of said second base strip, said third and fourth closure profiles being parallel to and spaced apart from each other and respectively interlockable with said first and second closure profiles to form first and second closures, wherein said first base strip is joined to said first wall in a first band-shaped zone of joinder, and said second base strip is joined to said second wall in a second band-shaped zone of joinder;

a first web of film joined to said first base strip along a perimeter of said first web, said first web comprising first and second longitudinal portions joined to first and second band-shaped zones of said first base strip, respectively, and first and second ends incorporated in said respective joined zipper ends, said first and second band-shaped zones being disposed at different elevations within said dual zipper; and a second web of film joined to said second wall along a perimeter of said second web, said second web comprising third and fourth longitudinal portions joined to third and fourth band-shaped zones of said second base strip, respectively, and third and fourth ends incorporated in said respective joined zipper ends, said third and fourth band-shaped zones being disposed at different elevations within said dual zipper;

wherein said second closure is disposed between said receptacle bottom and said first closure, and at least one of said second and fourth closure profiles has at least one evacuation hole, and further wherein unattached portions of the first and second webs within their respective perimeters come into contact continuously from said first side seam to said second side seam when said interior volume is evacuated via said at least one evacuation hole.

11. The bag as recited in claim 10, further comprising a valve assembly installed in a hole in said first wall for evacuating air from said interior volume.

12. The bag as recited in claim 10, wherein said film has the property that it adheres to itself and to non-adherent surfaces.

* * * * *